US008491809B2

(12) United States Patent
Yamada et al.

(10) Patent No.: US 8,491,809 B2
(45) Date of Patent: Jul. 23, 2013

(54) PROCESS FOR PRODUCTION OF ALUMINUM WHEEL

(75) Inventors: Takeshi Yamada, Anjo (JP); Yoshitomo Fujii, Anjo (JP); Hiroyuki Sato, Tokyo (JP); Soichi Nomoto, Tokyo (JP)

(73) Assignees: Central Motor Wheel Co., Ltd., Aichi (JP); Nihon Parkerizing Co., Ltd., Tokyo (JP)

( * ) Notice: Subject to any disclaimer, the term of this patent is extended or adjusted under 35 U.S.C. 154(b) by 194 days.

(21) Appl. No.: 13/060,284

(22) PCT Filed: Aug. 19, 2009

(86) PCT No.: PCT/JP2009/064499

§ 371 (c)(1),
(2), (4) Date: Feb. 23, 2011

(87) PCT Pub. No.: WO2010/026876

PCT Pub. Date: Mar. 11, 2010

(65) Prior Publication Data

US 2011/0155949 A1 Jun. 30, 2011

(30) Foreign Application Priority Data

Sep. 3, 2008 (JP) ..... 2008-225644

(51) Int. Cl.
*C23F 1/00* (2006.01)

(52) U.S. Cl.
USPC ..... 216/102; 216/83; 216/96; 216/99; 216/100; 216/108; 252/79.1; 252/79.4; 252/79.5

(58) Field of Classification Search
None
See application file for complete search history.

(56) References Cited

U.S. PATENT DOCUMENTS

2007/0184997 A1* 8/2007 Hino et al. ..... 510/201

FOREIGN PATENT DOCUMENTS

| | | | |
|---|---|---|---|
| JP | 07-090629 | A | 4/1995 |
| JP | 08-269757 | A | 10/1996 |
| JP | 2002-088492 | A | 3/2002 |
| JP | 2004-315864 | A | 11/2004 |

OTHER PUBLICATIONS

English translation of the International Preliminary Report on Patentability dated Apr. 21, 2011, from the International Bureau of WIPO in related International Patent Application No. PCT/JP2009/064499 (5 pages).
International Search Report w/translation from PCT/JP2009/064499 dated Oct. 27, 2009 (4 pages).
Patent Abstracts of Japan Publication No. 2004-315864 dated Nov. 11, 2004 (1 page).
Patent Abstracts of Japan Publication No. 2002-088492 dated Mar. 27, 2002 (1 page).
Patent Abstracts of Japan Publication No. 08-269757 dated Oct. 15, 1996 (1 page).
Patent Abstracts of Japan Publication No. 07-090629 dated Apr. 4, 1995 (1 page).

* cited by examiner

*Primary Examiner* — Lan Vinh
*Assistant Examiner* — Jiong-Ping Lu
(74) *Attorney, Agent, or Firm* — Osha Liang LLP

(57) ABSTRACT

A process for producing an aluminum wheel includes a cleaning step, in which the surface of the aluminum wheel is chemically etched with an alkali cleaning liquid which contains an alkali builder, an organic builder, and a chelating agent to such an extent that the Si atomic ratio of metal Si to oxide Si is from 0.01 to 9, and a shot blast treatment step can be omitted for cleaning the surface of the aluminum wheel.

13 Claims, 1 Drawing Sheet

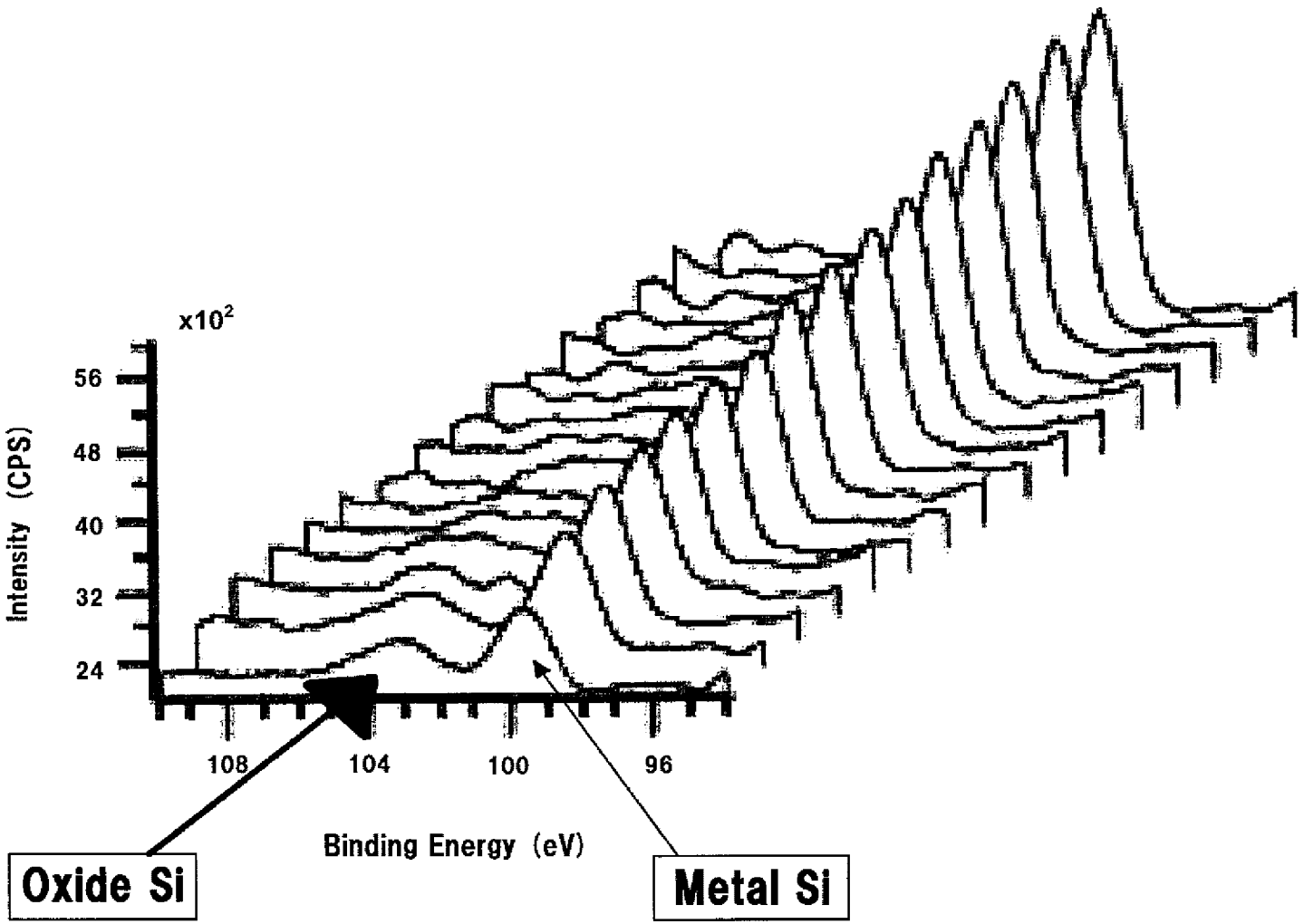
Intensity (CPS)
x10²
56
48
40
32
24
108
104
100
96
Binding Energy (eV)
Oxide Si
Metal Si

PROCESS FOR PRODUCTION OF ALUMINUM WHEEL

TECHNICAL FIELD

The present invention relates to a process for producing an aluminum wheel, which comprises a step of chemically etching, with an alkali cleaning liquid, an aluminum wheel cast by a casting method (e.g., low-pressure, medium-pressure, gravity and tilt casting methods), in particular except a high-pressure casting method, wherein a shot blast treatment step can be omitted for cleaning a surface of the aluminum wheel.

BACKGROUND ART

Surfaces of aluminum wheels after being cast are covered with thick oxide films and mold release agents. Specifically, first in heat treatment at casting, films of aluminum oxide and oxides of various metals contained in the bulk of aluminum material are formed on the aluminum surfaces. Further, when a mold release agent containing Si is used at casting, such Si is oxidized in a heat treatment step after the casting, to further grow the oxide films. Here, from the viewpoint of adhesion with surface treatment agents and films in subsequent steps and of corrosion resistance, the oxide films need removing. A caustic soda etching and an acid pickling step as desmutting can be applied to alumite treatment etc. during a step of coating treatment. In the production of aluminum wheels, however, bright designability of surfaces are sometimes required, and therefore, etching pursuing for surface cleaning may not be applicable to a surface treatment step set in a coating step.

As such, conventionally, shot blasting has been used to first clean the surfaces so that the effects of surface cleaning may be enhanced through degreasing, acid pickling and a hexavalent chromium-containing chromate in the surface treatment of the subsequent step. When shot blast treatment is carried out, however, residual iron after the shot blast treatment needs to be adequately removed. Such residual iron may be responsible for inhibiting adhesion between the aluminum wheels and the coated films, or moisture and like in the air may permeate through the coated films so that the moisture, the iron and the aluminum as substrate may react to cause a decrease in corrosion resistance. Also for chromate treatment, surface treatment systems have been replaced with non-chromates in accordance with the European ELV regulations and, therefore, surface cleaning by virtue of strong oxidizing potency of chromium may no longer be expected.

Patent Reference No. 1: Japanese Unexamined Patent Publication 2004-315864

DISCLOSURE OF THE INVENTION

Problems to be Solved by the Invention

Here, Patent Reference No. 1 describes a surface treatment method wherein sufficient coated film formability and corrosion resistance for aluminum wheel casting basis metals are secured even with the omission of conventional shot blasting steps. Here, etching agents (alkalis) to be used in the method are, for example, strong alkalis, such as caustic alkalis, alkali metal phosphates and alkali metal borates ([0020]). When etching agents with such compositions are used, however, various metal oxide films formed on the surfaces of the aluminum wheels may not be uniformly removed and, instead, only aluminum may be selectively removed, enriching heterogeneous metals on the surfaces. Therefore, when subsequent surface treatment (nonchromate treatment of dry-in-place/conversion type) is carried out with oxides such as Mg, Si and Fe remaining, a problem may remain in which adhesion with a nonchromate film and corrosion resistance may decrease to a great degree.

As such, it is an object of the present invention to provide, in a process for producing an aluminum wheel cast according to a casting method (e.g., low-pressure, medium-pressure, gravity and tilt casting methods), in particular, except a high-pressure casting method, a means capable of attaining sufficient adhesion between the aluminum wheel and nonchromate films and corrosion resistance, even when nonchromate treatment is carried out after casting.

Means for Solving the Problems

First, instead of an etching agent capable of removing only aluminum, the inventors selected an etching agent capable of removing heterogeneous metals and their oxides contained in aluminum wheels cast according to a casting method (e.g., low-pressure, medium-pressure, gravity and tilt casting methods) except a high-pressure casting method. Thereupon, using Si as an index, which is supposed to be present in the greatest abundance of the heterogeneous metals present on the surfaces or in the interiors of the aluminum wheel, the inventors have found that shot blasting steps could be omitted for aluminum wheels cast at low to medium pressures by controlling the Si atomic ratio between metal Si and oxide Si on the surfaces of the aluminum wheels at a predetermined rate, to accomplish the present invention. In other words, the present invention is characterized by setting the Si atomic ratio of metal Si to oxide Si (metal Si/oxide Si) at a predetermined ratio.

Specifically, when the etching agent according to the present invention is used and the Si atomic ratio of metal Si to oxide Si on the aluminum wheel surface is set at 0.01 or higher, metal oxide films on the surfaces may be sufficiently removed with a result that sufficient adhesion with a nonchromate film and corrosion resistance mentioned above can be secured. On the other hand, when the etching agents according to the present invention are used and the Si atomic ratio of metal Si to oxide Si on the aluminum wheel surfaces is set at 9 or lower, it may be possible to avoid a decrease in adhesion and corrosion resistance, called local cell corrosion, due to excessive etching. When the Si atomic ratio of metal Si to oxide Si on the aluminum wheel surfaces is lower than 0.01, adhesion with a nonchromate film and corrosion resistance may decrease due to the influence of the metal oxide films on the aluminum wheel surfaces. Also, when the Si atomic ratio of metal Si to oxide Si on the aluminum wheel surfaces is higher than 9, local cell may arise due to the enrichment of metal Si, subsequently decreasing corrosion resistance of the wheels.

That is, the present invention (1) is a process for producing an aluminum wheel, cast according to a casting method (e.g., low-pressure, medium-pressure, gravity and tilt casting methods) in particular except a high-pressure casting method, which comprises a cleaning step in which a surface of the aluminum wheel is chemically etched with an alkali cleaning liquid which contains an alkali builder, an organic builder and a chelating agent to such an extent that the Si atomic ratio of metal Si to oxide Si on the surface of the aluminum wheel may be from 0.01 to 9, wherein a shot blast treatment step can be omitted for cleaning the aluminum wheel surface.

The present invention (2) is the process according to the invention (1) wherein the alkali builder is one or more selected from the group consisting of an alkali metal hydroxide, an alkali metal carbonate, an inorganic alkali metal phosphate, an alkali metal silicate and an alkali metal alminate, and the alkali cleaning liquid is adjusted to from pH 10 to 13.

The present invention (3) is the process according to the invention (1) or (2) wherein the organic builder is an organic phosphonic acid or a salt thereof and/or a homo- or copolymer of an ethylenically unsaturated organic acid monomer (including a copolymer with another ethylenically monomer) having a molecular weight of from 500 to 10,000 or a salt thereof.

The present invention (4) is the process according to any one of the inventions (1) to (3) wherein the chelating agent is one or more selected from the group consisting of tartaric acid, citric acid, malic acid, glycolic acid, gluconic acid, heptogluconic acid, ethylenediaminetetraacetic acid, diethylenetriaminepentaacetic acid and L-glutamic acid.

The present invention (5) is the process according to any one of the inventions (1) to (4) wherein the amount of etching is from 0.1 to 10 $g/m^2$ in the cleaning step.

Definition of the terms used in CLAIMS and DESCRIPTION is now described. First, "oxide Si" refers to what is recognized as an oxidative product of Si when an X-ray electron spectroscope for chemical analysis (ESCA) is used, specific examples of which may include SiO and $SiO_2$ and the like. An "alkali builder" refers to an inorganic component of an alkali cleaning agent, examples of which include an alkali metal salt and the like which is capable of maintaining the pH between 10 and 13.

Effects of the Invention

According to the present invention, in addition to using an alkali cleaning liquid capable of dissolving various metals and metal oxides, since attention is paid on a predetermined parameter so that the value of the parameter may be controlled within a predetermined range, such effects may be obtained as (1) metal and metal oxide films on the aluminum wheel surface can be uniformly and sufficiently removed with a result that sufficient adhesion with a nonchromate film and corrosion resistance can be secured for the aluminum wheel cast according to a casting method (e.g., low-pressure, medium-pressure, gravity and tilt casting methods) except a high-pressure casting method, without carrying out a shot blasting step, (2) local cell corrosion due to excessive etching can be inhibited, (3) an excessive amount of metal Si on the aluminum wheel surface due to excessive etching can be inhibited with a result that chromium-free treatment represented by Zr-based chromium-free surface treatment more susceptible to the presence of excessive Si on the surface than chromate treatment can be accommodated, without excessively lowering the reactivity of the aluminum wheel surface, and (4) further, an increase in the cost for surface treatment and effluent treatment due to excessive etching can be suppressed.

BEST MODE FOR CARRYING OUT THE INVENTION

The present invention is described in more detail hereinafter. The present invention is a process for producing an aluminum wheel cast according to a casting method (e.g., low-pressure, medium-pressure, gravity and tilt casting methods), in particular, except a high-pressure casting method, which comprises a cleaning step in which the aluminum wheel surface is contacted with an alkali cleaning liquid which contains an alkali builder, an organic builder and a chelating agent to remove and clean the surface by removing the oxide Si on the surface, so that the Si atomic ratio of metal Si to oxide Si may be controlled from 0.01 to 9, wherein a shot blast treatment step can be omitted for cleaning the aluminum wheel surface. First, the alkali cleaning liquid to be used in the cleaning step is described, followed by description of each step.

Alkali Cleaning Liquid

An alkali cleaning liquid according to the present invention is an aqueous solution containing an alkali builder, an organic builder and a chelating agent. Each component is described below, and description of their physical properties follows.

Alkali Builders

Any water-soluble alkalis can be used as alkali builders according to the present invention. Specific examples may include alkali metal hydroxides, such as sodium hydroxide and potassium hydroxide, alkali metal silicates, such as sodium orthosilicate, sodium metasilicate, potassium orthosilicate and potassium metasilicate, alkali metal phosphates or hydrogen phosphates, such as sodium phosphate, sodium hydrogen phosphate (NaHPO, NaHPO), potassium phosphate and potassium hydrogen phosphate (KHPO, KHPO), alkali metal polyphosphates, such as potassium tripolyphosphate and sodium tripolyphosphate, alkali metal carbonates, such as sodium carbonate and potassium carbonate as well as sodium aluminate. They can be used alone or in combination of two or more.

While the alkali builders (sources) according to the present invention may not necessarily contain an alkali metal hydroxide as a component, usually they are preferably composed of 1 mol % of an alkali metal hydroxide or more, in particular sodium hydroxide and, if not of 100%, other alkali agents, preferably at least one selected from the group consisting of poorly soluble alkali builders, such as alkali metal silicates, alkali metal phosphates or alkali metal hydrogen phosphates and alkali metal polyphosphates; in particular, at least one selected from the group consisting of sodium orthosilicate and sodium phosphate or sodium hydrogen phosphate. Also, when an alkali metal phosphate, an alkali metal hydrogen phosphate or an alkali metal polyphosphate is used, it is usually preferred to use alkali metal hydroxides in combination (usually at or more than twice the molar amount).

While the total amount of the alkali builders according to the present invention is not particularly limited, it is preferably from 10 to 100 g/L and more preferably from 30 to 60.0 g/L. At less than 10 g/L, etching may be insufficient and aluminum surface may be nonuniform. Also, at more than 100 g/L, no better effects may be observed from the viewpoint of etching and performance and aluminum surface may unfavorably undergo surface roughening due to excessive etching.

Organic Builders

Organic builders (sources) according to the present invention are preferably (X) an organic phosphonic acid or a salt thereof, (Y) a homo- or copolymer of an ethylenically unsaturated organic acid monomer (including a copolymer with another ethylenically monomer) having a molecular weight of 500 to 10,000 or salts thereof, alone or in combination of two or more. Details are described below.

First, examples of organic phosphonic acids or salts thereof as (X) may include aminotrimethylenephosphonic acid, ethylenediaminetetramethylenephoshonic acid, alkanediphosphonic acids (e.g., ethane-1,1-diphosphonic acid) and hydroxyalkanediphosphonic acids (e.g., 1-hydroxyethylidene-1,1-diphosphonic acid).

Next, homo- or copolymers of an ethylenically unsaturated organic acid monomer (including a copolymer with another ethylenic monomer) having a molecular weight of from 500 to 10,000 or salts thereof as (Y) must have a weight average molecular weight of 500 to 10,000, preferably 750 to 5,000 and more preferably 1,000 to 3,000 as determined by gel permeation chromatography using styrene as reference material. When the molecular weight is less than 500, etching uniformity for heterogeneous metals may deteriorate, while when the molecular weight is more than 10,000, organic builders themselves may have excessively high viscosity and the concentrations in aqueous solutions may not be increased so that ease of handling may be impaired and formulation may be difficult.

Here, examples of such homo- or copolymers of ethylenically unsaturated organic acid monomers may include homopolymers of ethylenically unsaturated organic acid monomers or copolymers consisting of two or more thereof, or copolymers of at least one of ethylenically unsaturated organic acid monomers and at least one of another ethylenic monomer. Among them, as copolymers with another ethylenic monomer, those containing 70 mol % or more, or 90 mol % or more of ethylenically unsaturated organic acid monomer units are preferred for corrosion resistance and adhesion.

More specific examples of the homo- or copolymers of ethylenically unsaturated organic acid monomers described above may include homopolymers of ethylenically unsaturated organic acid monomers described in (1) below or copolymers consisting of two or more thereof, or copolymers of at least one of ethylenically unsaturated organic acid monomers described in (1) below and at least one of monomers described in (2) to (6) below. As copolymers of monomers of (1) below and monomers of (2) to (6) below, those containing 70 mol % or more, or 90 mol % or more of monomer units of (1) below are preferred for providing stable dispersion effects. Examples of ethylenically unsaturated organic acid monomers may include ethylenically unsaturated carboxylic acid monomers and ethylenically unsaturated sulfonic acid monomers as described in (1) below, ethylenically unsaturated carboxylic acid monomers being more preferred.

Thus, among such homo- or copolymers of ethylenically unsaturated organic acid monomers or salts thereof, preferred are homopolymers of ethylenically unsaturated carboxylic acid monomers of (1) below or copolymers consisting of two or more thereof, or copolymers of at least one of ethylenically unsaturated carboxylic acid monomers of (1) below and at least one of monomers of (2) to (6) below, which contain 70 mol % or more, or 90 mol % or more of the carboxylic acid monomer units, or alkali metal salts thereof. More preferred are homopolymers of acrylic acid or maleic acid or copolymers consisting of the both at any proportion, or copolymers of at least one selected from the group consisting of acrylic acid and maleic acid and at least one of monomers of (2) to (6) below, which contain 70 mol % or more, or 90 mol % or more of the carboxylic acid monomer units, or alkali metal salts thereof.

Examples of salts of homo- or copolymers of ethylenically unsaturated organic acid monomers may include alkali metal salts (e.g., sodium salts and potassium salts) or ammonium salts or lower amine salts (e.g., triethylammonium salt) of such homo- or copolymers. Also, the organic acid monomer units in the copolymers can be all or partly in salt forms. Commercial products of the homo- or copolymers of ethylenically unsaturated organic acid monomers or salts thereof mentioned above are usable and generally available as aqueous solutions.

(1) Ethylenically unsaturated carboxylic acid monomers, such as acrylic acid, maleic acid, methacrylic acid, crotonic acid, itaconic acid and fumaric acid and half esters of dibasic acids among them, ethylenically unsaturated sulfonic acid monomers, such as vinylsulfonic acid, methallylsulfonic acid, styrenesulfonic acid and 2-acrylamido-2-methylpropanesulfonic acid.

(2) (Meth)acrylamides having N-unsubstituted or lower alkyl-substituted methylol groups, such as N-methylol acrylamide, N-methylol methacrylamide, N-butoxymethyl acrylamide and N-butoxymethyl methacrylamide; (meth)acrylamides; N-alkyl (C=1 to 8, in particular C=1 to 4) (meth) acrylamides, such as N-methyl (meth)acrylamide, N-ethyl (meth)acrylamide, N-n-propyl (meth)acrylamide, N-t-butyl (meth)acrylamide and N-t-octyl (meth)acrylamide; N,N-dilower alkyl (meth)acrylamides, such as N,N-dimethyl (meth) acrylamide and N,N-diethyl (meth)acrylamide; N-benzyl (meth)acrylamide; (meth)acrylamide-based monomers, such as N-cyclohexyl (meth)acrylamide.

(3) Phosphonyloxy-lower alkyl (meth)acrylates, such as phosphonyloxymethyl acrylate, phosphonyloxyethyl acrylate, phosphonyloxypropyl acrylate, phosphonyloxymethyl methacrylate, phosphonyloxyethyl methacrylate and phosphonyloxypropyl methacrylate.

(4) Lower alkoxy-lower alkyl (meth)acrylates, such as methoxymethyl acrylate, methoxyethyl acrylate, ethoxymethyl acrylate, ethoxyethyl acrylate, methoxymethyl methacrylate, methoxyethyl methacrylate, ethoxymethyl methacrylate, ethoxyethyl methacrylate, and methoxybutyl acrylate; hydroxy-lower alkyl (meth)acrylates, such as 2-hydroxyethyl (meth)acrylate and 3-hydroxypropyl (meth)acrylate.

(5) Alkyl (C=1 to 8) (meth)acrylates, such as methyl acrylate, methyl methacrylate, ethyl acrylate, ethyl methacrylate, isopropyl methacrylate, n-butyl acrylate, n-butyl methacrylate, t-butyl acrylate, 2-ethylhexyl methacrylate and octyl acrylate.

(6) Other ethylenic monomers, such as styrene, methylstyrene, vinyl acetate, acrylonitrile, vinyl esters of saturated carboxylic acids branched at a positions, vinyl chloride, vinyltoluene and ethylene.

"Lower" as used in (1) to (6) described above for lower alkyl and lower alkoxy means a carbon number of 1 to 4, in particular of 1 to 2.

While the total amount of the organic builders according to the present invention is not particularly limited, preferably are from 0.2 to 20.0 g/L and more preferably from 1.0 to 10.0 g/L, for example when (X) and/or (Y) components are used. At less than 0.2 g/L, inhibitory effects on smut generation, adsorbed onto the surface of aluminum hydroxide and the like, generated by typical caustic soda etching may not be observed, while at more than 20 g/L, remarkable effects may not be observed and cost may unfavorably increase.

Chelating Agents

Examples of chelating agents according to the present invention may include aminocarboxylic acids, such as L-glutamic acid, nitrilotriacetic acid, ethylenediaminetetraacetic acid, ethylenediaminediacetic acid and triethylenetetraminehexaacetic acid, or alkali metal salts thereof (e.g., sodium salt, potassium salt), or ammonium or lower amine salts thereof (e.g., triethylamine salt), oxycarboxylic acids, such as malic acid, citric acid, gluconic acid and heptogluconic acid or alkali metal salts thereof (e.g., sodium salt, potassium salt), or ammonium or lower amine salts thereof (e.g., triethylamine salt). Among these, oxycarboxylic acids or salts thereof, in particular, alkali metal salts of oxycarboxylic acids are preferably used. The chelating agents described above can be used alone or in combination of two or more.

The total amount of the chelating agents according to the present invention is preferably from 0.1 to 10 g/L and more preferably from 0.5 to 5 g/L on the basis of the total amount of the alkali cleaning agent. When the amount incorporated is less than 0.1 g/L, improvement in cleaning effects may be insufficient, while at more than 10 g/L, the effects may reach saturation, with a disadvantage in economy.

Other Components

The alkali cleaning agent according to the present invention may contain other components as necessary, examples of which may include surfactants for cleaning and defoaming agents.

Physical Properties of Alkali Cleaning Agent

The alkali cleaning agent according to the present invention has a pH of preferably from 10 to 13 and more preferably from 11 to 12.5.

Process for Producing Aluminum Wheels

Next, a process for producing aluminum wheels is described below. First, for producing aluminum wheels, while there are a process in which melted aluminum alloy (molten metal) is poured into molds and solidified into a shape of a wheel (casting) and a process in which light alloy is pressed under several thousand tons of force into molds (forging), the process for producing aluminum wheels according to the present invention is that related to casting. Then, the process for producing aluminum wheels according to the present invention is characterized in that a shot blasting step can be omitted after casting by a casting method (e.g., low-pressure, medium-pressure, gravity and tilt casting methods) except a high-pressure casting method. In the process for producing aluminum wheels according to the present invention, the only novel step is about a chemical etching step, and the other steps are not different from those of conventional processes. Therefore, the steps described below are nothing but examples and the present invention encompasses all the processes known for producing aluminum wheels by casting. Therefore, processes including steps not specifically described below that can be incorporated into processes for producing aluminum wheels (e.g., solution heat treatment, water quenching and aging treatment) are also within the technical scope of the present invention as long as they are processes for producing aluminum wheels including a chemical etching step after a casting step.

Casting Step

A casting step according to the present invention is a one in which material for aluminum wheels is poured into molds that are applied with a mold release agent, carried out according to a casting method (e.g., low-pressure, medium-pressure, gravity and tilt casting methods) except a high-pressure casting method. Here, as materials for aluminum wheels, aluminum alloy substrates (e.g., AC-4C or AC-4-CH) are usable for example. For example, AC-4-CH is an aluminum alloy which contains from 6.5 to 7.5% by weight of Si, from 0.2 to 0.4% by weight of Mg and equal to or less than 0.2% by weight of Fe. Thus, the aluminum alloy substrates mentioned above contain Si in the greatest abundance as a heterogeneous metal other than aluminum. In addition to the heterogeneous metals mentioned above, Cu and Ni are contained as well.

Chemical Etching Step

A chemical etching step according to the present invention is a step in which the alkali cleaning liquid mentioned above is applied to the aluminum wheel surface after being cast according to a casting method (e.g., low-pressure, medium-pressure, gravity and tilt casting methods) except a high-pressure casting method. While the step is not particularly limited, it is desirable that the step should be carried out at a temperature of the treatment solution of 30 to 60° C. for a time period of 30 seconds to 10 minutes and that the alkali liquid remaining on the surface thereafter should be removed by rinsing. The aluminum wheel surface is etched by the alkali cleaning liquid so that films of aluminum oxide and other metal oxides as well as organic impurities such as mechanical oil and cutting oil deposited on the aluminum wheel surface may be removed. In so doing, it may be recommended that the Si atomic ratio of metal Si to oxide Si on the aluminum wheel surface should be controlled from 0.01 to 9 and preferably from 0.05 to 5 and more preferably from 0.1 to 1. Thus, by setting the atomic ratio at 0.01 or higher, the metal oxide films on the surface are sufficiently removed, with a result that sufficient adhesion with a non-chromate film to be formed subsequently and corrosion resistance can be secured. On the other hand, by setting the atomic ratio at 9 or lower, local cell corrosion due to excessive etching can be avoided. Here, the Si atomic ratio of metal Si to oxide Si is calculated using an X-ray electron spectroscope for chemical analysis (ESCA) on the basis of strength of oxide Si and metal Si. In so doing, the amount of etching is preferably from 0.1 to 10 g/m$^2$ and more preferably from 5 to 7 g/m$^2$. Here, the "aluminum wheel surface" of the "Si atomic ratio of metal Si to oxide Si on the aluminum wheel surface" usually refers to, but not necessarily limited to, a surface after lightly sputtering the outermost surface. In this case, while it is considered that the "aluminum surface" may vary more or less depending on the analysis conditions, it is usually desirable that measurement should be made at depthwise portions several nm to approximately 200 nm, by way of example, 6 to 200 nm from the outermost surface of the aluminum. Thus, the outermost surface is excluded from measurement because component contamination and oxidation may inevitably occur when the outermost surface is measured. Therefore, this time, information from the outermost surface and the outermost layer (layer 1) is excluded. The atomic ratio of metal Si to oxide Si means an average value of ratios measured at various layers of depthwise portions from 6 to 200 nm from the outermost surface, as illustrated in EXAMPLES.

Rinsing Step

After the chemical etching step, it is preferred to carry out two or more of rinsing steps. The alkali cleaning liquid can be diluted thereby to terminate reactions. Further, through the rinsing treatment, the amount of the alkali cleaning liquid of the step described above to be carried over to the next step can be reduced.

Pretreatment Step for Coating

After the rinsing step, surface treatment for coating is carried out in a separate to step. This surface treatment for coating is composed of degreasing treatment, acid pickling treatment and chemical conversion treatment. Rinsing treatment is carried out between the steps. Posttreatment can be carried out after the chemical conversion treatment. Also, while an example of surface treatment by chemical conversion is described in BEST MODE, the surface treatment is not limited thereto and can be of dry-in-place type.

First, the degreasing treatment is not particularly limited, examples of which may include alkali degreasing used in ordinary treatment of aluminum wheels. Through the degreasing treatment, fat and oil substances can be removed or lifted off to the surface. In addition, wettability toward aluminum wheels of an acidic aqueous solution used in acid pickling treatment to be subsequently carried out may improve so that more reliable acid pickling may be carried out.

After the degreasing treatment described above, it is preferred to carry out rinsing treatment twice or more. The treatment agent used in the degreasing treatment can be diluted thereby to terminate reactions. In addition, through this rinsing treatment, the amount of the treatment agent of the step described above to be carried over to the next step can be reduced.

After the rinsing treatment described above, acid pickling treatment is carried out. The acid pickling treatment can be carried out in a method used in pretreatment for coating having nonchromate treatment in aluminum wheels. By carrying out the acid pickling, stains and oxide films on the aluminum wheel can be removed. In addition, by carrying out the acid pickling, the surface of the aluminum wheel may be activated so that a chemically converted film may be easily formed.

After the acid pickling described above, rinsing treatment is carried out. It is preferred to carry out the rinsing treatment twice or more. The treatment agent used in the acid pickling can be diluted thereby to terminate reactions. In addition, through this rinsing treatment, the amount of the treatment agent of the step described above to be carried over to the next step can be reduced.

Next, chemical conversion treatment and, if necessary, posttreatment are carried out to form a chemically converted film on the aluminum wheel surface. The chemical conversion treatment and the posttreatment can be carried out according to the processes for nonchromate treatment to be used for pretreatment for coating of aluminum wheels as described in Japanese Unexamined Patent Publication No. 2003-313681 and Japanese Unexamined Patent Publication No. 2003-27253, for example. In the nonchromate treatment, as metals for substituting chromium ions, single metal salts each consisting of cobalt, zinc, titanium, silica, vanadium, cerium, molybdenum, tungsten, zirconium or the like or complex metal salts of a combination thereof are used. A sulfate salt, a phosphate salt, a nitrate salt, a salt of hydrofluoric acid, a chloride salt, an aluminum salt, an acetate salt and the like are usable as such salts.

After the chemical conversion treatment, it is preferred to carry out rinsing treatment twice or more. After the rinsing treatment, draining is carried out by air blowing or the like, followed by carrying out drain drying.

Coating Step

After the pretreatment step for coating, the surface of the aluminum wheel is coated. In the coating step, ordinary coating methods used for aluminum wheels subjected to surface treatment having nonchromate treatment can be used.

EXAMPLES

For examples and comparative examples, cleaning liquids were prepared as listed in Table 1 and dipping treatment was carried out according to the methods described in Table 2, followed by treatment with pure water and a dryer to remove water remaining on the surface. Thereafter, the amount of etching, the ratio of metal Si/oxide Si (ESCA strength ratio), CASS after coating (according to JIS Z 8502) and the conditions of the films after 240 hours were studied. The results are summarized in Table 3. Here, the weight average molecular weight of acrylic resins was determined using a measurement device on the basis of GPC(HPC-220, TOSO Company limited) by measuring RI (refractive indices). The calculation of molecular weights was made in terms of polystyrene.

Pretreatment for coating and coating were carried out under the conditions below:

(1) Pretreatment for Coating

Degreasing, rinsing, acid pickling, rinsing, chemical conversion, rinsing, rinsing with pure water and drying (120° C., 20 minutes) were carried out in the mentioned order.

(1-1) Degreasing

Using a commercially available alkaline degreasing agent FC-359 (Nihon Parkerizing Co., Ltd.) spraying was carried out at 50° C. for 2 minutes.

(1-2) Acid Pickling

Using a commercially available acid pickling agent PL-5552 (Nihon Parkerizing Co., Ltd.) spraying was carried out at 50° C. for 1 minute.

(1-3) Chemical Conversion

Using a commercially available zirconium-based (Zr-based), chromium-free chemical conversion agent (Nihon Parkerizing Co., Ltd.) spraying was carried out at 45° C. for 1 minute.

(2) Coating

Using a commercially available powder coating EVA-CLAD 5600 (Kansai Paint Co., Ltd.), baking was carried out at a film thickness of 100 μm at 160° C. for 20 minutes, before applying a commercially available solvent-based coating Magicron ALC Base Clear (Kansai Paint Co., Ltd.) at a film thickness of 30 μm. Then, using a commercially available solvent-based coating Magicron ALC Clear (Kansai Paint Co., Ltd.) coating was carried out at a film thickness of 30 μm, before baking at 140° C. for 20 minutes.

Determination of the strength ratio between oxide Si and metal Si on the aluminum wheel surface was carried out using the device below under the conditions below. In EXAMPLES, strength ratios were measured at layers 2 to 15 (6 to 200 nm) excluding the outermost layer (layer 1) to designate the average value of the strength ratios as the "strength ratio" (see FIG. 1).

X-ray electron spectroscope for chemical analysis (ESCA)
Model: ESCA-850M (Shimadzu Corporation)
Excitation X ray: Mg—Kα
Excitation energy: 8 kV-30 mA
Analysis diameter: 6 mm
Sputtering rate: 80 nm/min (in terms of $SiO_2$)
Sputtering time: 35 seconds in total

TABLE 1

| | | pH | Alkali builders | | Organic builders | | Chelating agents | |
|---|---|---|---|---|---|---|---|---|
| Examples | 1 | 13.0 | NaOH | 60 g/L | Na polyacrylate 1000 | 10 g/L | Citric acid soda | 10 g/L |
| | 2 | 12.1 | NaOH + KOH | 10 gL + 10 g/L | Acrylic acid/Na maleate copolymer 2000 | 7 g/L | Gluconic acid soda | 3 g/L |
| | 3 | 11.3 | NaOH + NaAlO2 | 25 g/L + 30 g/L | Acrylic acid/Na maleate copolymer 5000 | 3 g/L | L-glutamic acid soda | 0.1 g/L |
| | 4 | 10.0 | KOH + NaAlO2 | 40 g/L + 10 g/L | Acrylic acid/Na sulfonate copolymer 5000 | 1 g/L | Ethylenediaminetetraacetic acid | 2 g/L |
| | 5 | 13.0 | NaOH + KOH | 20 g/L + 20 g/L | Ethane-1, 1-diphosphonic acid | 20 g/L | Gluconic acid soda | 3 g/L |
| | 6 | 12.6 | NaOH + NaAlO2 | 10 g/L + 50 g/L | Na polyacrylate 5000 | 8 g/L | L-glutamic acid soda | 6 g/L |
| | 7 | 13.0 | KOH + NaAlO2 | 50 g/L + 40 g/L | Acrylic acid/Na sulfonate copolymer 8000 | 6 g/L | Ethylenediaminetetraacetic acid | 0.5 g/L |

TABLE 1-continued

| | | pH | Alkali builders | | Organic builders | | Chelating agents | |
|---|---|---|---|---|---|---|---|---|
| Comparative Examples | 1 | 9.5 | Na3PO4 | 20 g/L | Na polyacrylate 1000 | 6 g/L | Citric acid soda | 10 g/L |
| | 2 | 1.3 | H2SO4 | 50 g/L | None | | Citric acid | 4 g/L |
| | 3 | 1.0 | HCL | 25 g/L | Polyacrylic acid 1000 | 10 g/L | Citric acid | 8 g/L |
| | 4 | 11.1 | NaAlO2 | 40 g/L | None | | None | |
| | 5 | 13.0 | NaOH | 150 g/L | None | | None | |

TABLE 2

| | Treatment solution temperatures | Treatment time periods | Treatment methods |
|---|---|---|---|
| Examples | | | |
| 1 | 35° C. | 60 seconds | Dipping |
| 2 | 40° C. | 60 seconds | Dipping |
| 3 | 45° C. | 120 seconds | Dipping |
| 4 | 45° C. | 180 seconds | Dipping |
| 5 | 50° C. | 180 seconds | Dipping |
| 6 | 55° C. | 120 seconds | Dipping |
| 7 | 60° C. | 180 seconds | Dipping |
| Comparative Examples | | | |
| 1 | 60° C. | 180 seconds | Dipping |
| 2 | 45° C. | 120 seconds | Dipping |
| 3 | 30° C. | 60 seconds | Dipping |
| 4 | 45° C. | 120 seconds | Dipping |
| 5 | 50° C. | 90 seconds | Dipping |

TABLE 3

| | Shot blasting | Amounts etched | Metal Si/ oxide Si | CASS performance after coating |
|---|---|---|---|---|
| Examples | | | | |
| 1 | Done | 1.0 g/m$^2$ | 0.01 | ○ |
| 2 | Not done | 1.8 g/m$^2$ | 0.18 | ○○ |
| 3 | Not done | 2.6 g/m$^2$ | 1.35 | ○○ |
| 4 | Not done | 5.6 g/m$^2$ | 1.98 | ○○ |
| 5 | Not done | 8.4 g/m$^2$ | 4.14 | ○○ |
| 6 | Not done | 10 g/m$^2$ | 6.03 | ○○ |
| 7 | Not done | 12 g/m$^2$ | 8.9 | ○ |
| Comparative Examples | | | | |
| 1 | Done | 0.1 g/m$^2$ | 0.001 | X |
| 2 | Not done | 0.05 g/m$^2$ | 0.001 | X |
| 3 | Not done | 0.8 g/m$^2$ | 0.009 | X |
| 4 | Not done | 0.3 g/m$^2$ | 0.008 | X |
| 5 | Not done | 30 g/m$^2$ | 10 | Δ |

BRIEF DESCRIPTION OF THE DRAWINGS

FIG. 1 is a chart with respect to strength ratios of oxide Si and metal Si measured at various layers of an aluminum wheel surface according to EXAMPLES.

What is claimed is:

1. A process for producing an aluminum wheel, comprising a cleaning step of chemically etching a surface of an aluminum wheel to be chemically treated with an alkali cleaning liquid which contains an alkali builder, an organic builder, and a chelating agent, to such an extent that a Si atomic ratio of metal Si to oxide Si on the surface of the aluminum wheel is from 0.01 to 9.

2. The process according to claim 1, wherein the alkali builder is one or more selected from the group consisting of an alkali metal hydroxide, an alkali metal carbonate, an inorganic alkali metal phosphate, an alkali metal silicate and an alkali metal alminate, and the alkali cleaning liquid is adjusted to from pH 10 to 13.

3. The process according to claim 2, wherein an amount of etching is from 0.1 to 10 g/m$^2$ in the cleaning step.

4. The process according to claim 1, wherein the organic builder is an organic phosphonic acid or a salt thereof and/or a homo- or copolymer of an ethylenically unsaturated organic acid monomer (including a copolymer with another ethylenically monomer) having a molecular weight of from 500 to 10,000 or a salt thereof.

5. The process according to claim 4, wherein an amount of etching is from 0.1 to 10 g/m$^2$ in the cleaning step.

6. The process according to claim 1, wherein the chelating agent is one or more selected from the group consisting of tartaric acid, citric acid, malic acid, glycolic acid, gluconic acid, heptogluconic acid, ethylenediaminetetraacetic acid, diethylenetriaminepentaacetic acid and L-glutamic acid.

7. The process according to claim 6, wherein an amount of etching is from 0.1 to 10 g/m$^2$ in the cleaning step.

8. The process according to claim 1, wherein an amount of etching is from 0.1 to 10 g/m$^2$ in the cleaning step.

9. The process according to claim 1, wherein the process does not comprise a shot blast treatment.

10. The process according to claim 1, wherein the aluminum wheel to be chemically treated is an aluminum wheel cast obtained with a casting method other than a high-pressure casting method.

11. The process according to claim 1, wherein the aluminum wheel to be chemically treated contains from 6.5 to 7.5% by weight of Si.

12. The process according to claim 1, wherein the etching is performed to such an extent that the Si atomic ratio of metal Si to oxide Si on the surface of the aluminum wheel is from 0.05 to 5.

13. The process according to claim 1, wherein the etching is performed to such an extent that the Si atomic ratio of metal Si to oxide Si on the surface of the aluminum wheel is from 0.1 to 1.

* * * * *